US009516402B2

(12) United States Patent
Murozaki

(10) Patent No.: US 9,516,402 B2
(45) Date of Patent: Dec. 6, 2016

(54) EARPIECE AND ELECTRO-ACOUSTIC TRANSDUCER WITH PROTRUSIONS AND/OR GROOVED PASSAGES

(71) Applicant: Sony Corporation, Minato-ku (JP)

(72) Inventor: Katsunori Murozaki, Chiba (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/588,534

(22) Filed: Jan. 2, 2015

(65) Prior Publication Data

US 2015/0222978 A1 Aug. 6, 2015

(30) Foreign Application Priority Data

Feb. 6, 2014 (JP) ..... 2014-021014

(51) Int. Cl.
*H04R 1/10* (2006.01)

(52) U.S. Cl.
CPC ..... *H04R 1/1016* (2013.01)

(58) Field of Classification Search
CPC ..... H04R 1/10; H04R 1/1016; H04R 1/1058; H04R 2201/10
USPC ..... 381/328, 380
See application file for complete search history.

(56) References Cited

U.S. PATENT DOCUMENTS 7,013,016 B2 * 3/2006 Wolf ..... 381/324
8,340,335 B1 * 12/2012 Shennib ..... H04R 25/60 381/315
2011/0019851 A1 * 1/2011 Michel ..... H04R 25/606 381/326
2013/0163803 A1 * 6/2013 Erdel ..... 381/373

FOREIGN PATENT DOCUMENTS

JP 2003-284177 10/2003

* cited by examiner

*Primary Examiner* — Ahmad F Matar
*Assistant Examiner* — Katherine Faley
(74) *Attorney, Agent, or Firm* — Oblon, McClelland, Maier & Neustadt, L.L.P.

(57) ABSTRACT

An earpiece includes a fitting portion and an attachment portion. The fitting portion includes a first end, a second end, and an outer surface including a passage that connects the first end and the second end to each other. The attachment portion is disposed inside the fitting portion to be engaged to a sound guide tube of an electro-acoustic transducer.

14 Claims, 19 Drawing Sheets

A

B

C

A

B

EARPIECE AND ELECTRO-ACOUSTIC TRANSDUCER WITH PROTRUSIONS AND/OR GROOVED PASSAGES

CROSS REFERENCE TO RELATED APPLICATIONS

This application claims the benefit of Japanese Priority Patent Application JP 2014-021014 filed Feb. 6, 2014, the entire contents of which are incorporated herein by reference.

BACKGROUND

The present technology relates to an earpiece that is fitted in an ear canal of a user, and to an electro-acoustic transducer including the same.

SUMMARY

In related art, many inner type earphones with an earpiece-attached end, which are called earplug type, have been merchandised. The earpiece is attached to an end of a sound path tube of an electro-acoustic transducer and fitted in an ear canal of a user. In recent years, there are more and more needs for using this type of earpiece in sports such as jogging.

However, the earpiece easily falls out of the ear in sports because its frictional force with the ear canal is reduced due to adhesion of sweat, moisture, sebum, and the like. In view of this, for example, Japanese Patent Application Laid-open No. 2003-284177 (hereinafter, referred to as Patent Document 1) describes an ear pad that is removably fitted in an ear canal, in which many pleat-shaped sound shield walls made of the same elastic material as that of a main body are integrally provided in a ring shape at predetermined intervals in an axial direction to an outer peripheral surface of the main body formed like a hollow cylinder. Patent Document 1 says that such a configuration reduces the influence of reduction in frictional force due to sweat and sebum.

However, with the structure of Patent Document 1, once the outer peripheral surface of the ear pad gets wet from sweat and sebum, even if fitting is repeated over and over again, it is not possible to remove moisture of the sweat and sebum. Therefore, it is difficult to keep a comfortable fitting feeling without wiping off moisture on the outer peripheral surface every time the ear pad is fitted in the ear canal.

In view of the above-mentioned circumstances, it is an object of the present technology to provide an earpiece that can be prevented from falling out of an ear due to sweat and sebum and keep a comfortable fitting feeling and an electro-acoustic transducer including the same.

According to an embodiment of the present technology, there is provided an earpiece including a fitting portion and an attachment portion.

The fitting portion includes a first end, a second end, and an outer surface. The outer surface includes a passage that connects the first end and the second end to each other.

The attachment portion is disposed inside the fitting portion to be engaged to a sound guide tube of an electro-acoustic transducer.

The earpiece guides moisture such as sweat and sebum between the outer surface of the fitting portion and an inner wall surface of the ear canal into the passage and suppresses a reduction in frictional force between the fitting portion and the ear canal. This can make it difficult for the earpiece to fall out of the ear also in sports, for example. Further, when the earpiece is inserted into the ear canal, it is possible to discharge moisture adhering to the inner wall of the ear canal to an outside of the ear through the passage. With this, it becomes possible to give a comfortable fitting feeling without needing a work to wipe off moisture on the fitting portion surface.

The passage may be formed among a plurality of protrusions provided in the outer surface or may be a groove portion formed in the outer surface.

The passage typically includes a plurality of first passage portions formed along an axial direction of the fitting portion. The first passage portions may be linear passages or may be serpentine passages.

In this case, the passage may further include a plurality of second passage portions that connect the plurality of first passage portions to one other.

The plurality of protrusions may each include a first edge portion and a second edge portion. The first edge portion is an edge portion having a taper shape formed on a side of the first end, and the second edge portion is an edge portion having an edge shape formed on a side of the second end.

The first edge portion is formed in a taper shape, and hence the wearing properties of the earpiece to the ear canal is improved. On the other hand, the second edge portion is formed in an edge shape, and hence, when the earpiece is pulled out from the ear canal, an action of scraping off moisture such as sweat and sebum adhering to the inner wall surface of the ear canal can be provided.

Alternatively, the plurality of protrusions may have a sucker shape. With this, the close-contact property between the outer surface of the fitting portion and the inner wall surface of the ear canal can be improved.

The fitting portion may further include a plurality of through-holes provided in the passage. With this, moisture in the passage can be guided to the inner surface of the fitting portion, and hence the moisture discharging efficiency is improved.

According to another embodiment of the present technology, there is provided an earpiece including a fitting portion and an attachment portion.

The fitting portion includes a first end, a second end, and an outer surface including a passage capable of discharging moisture from the first end to the second end.

The attachment portion is disposed inside the fitting portion to be engaged to a sound guide tube of an electro-acoustic transducer.

According to still another embodiment of the present technology, there is provided an electro-acoustic transducer including a main body and an earpiece.

The main body includes an electro-acoustic transducer element, and a sound guide tube configured to output an acoustic wave generated by the electro-acoustic transducer element.

The earpiece includes a fitting portion and an attachment portion. The fitting portion includes a first end, a second end, and an outer surface including a passage that connects the first end and the second end to each other. The attachment portion is disposed inside the fitting portion to be engaged to the sound guide tube.

As described above, according to embodiments of the present technology, it is possible to prevent an earpiece from falling out of an ear due to sweat and sebum and keep a comfortable fitting feeling.

It should be noted that the effects described here are not necessarily limited and any effect described in the present disclosure may be provided.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, embodiments of the present technology will be described with reference to the drawings.

<First Embodiment>

[Electro-Acoustic Transducer]

Figure 1:
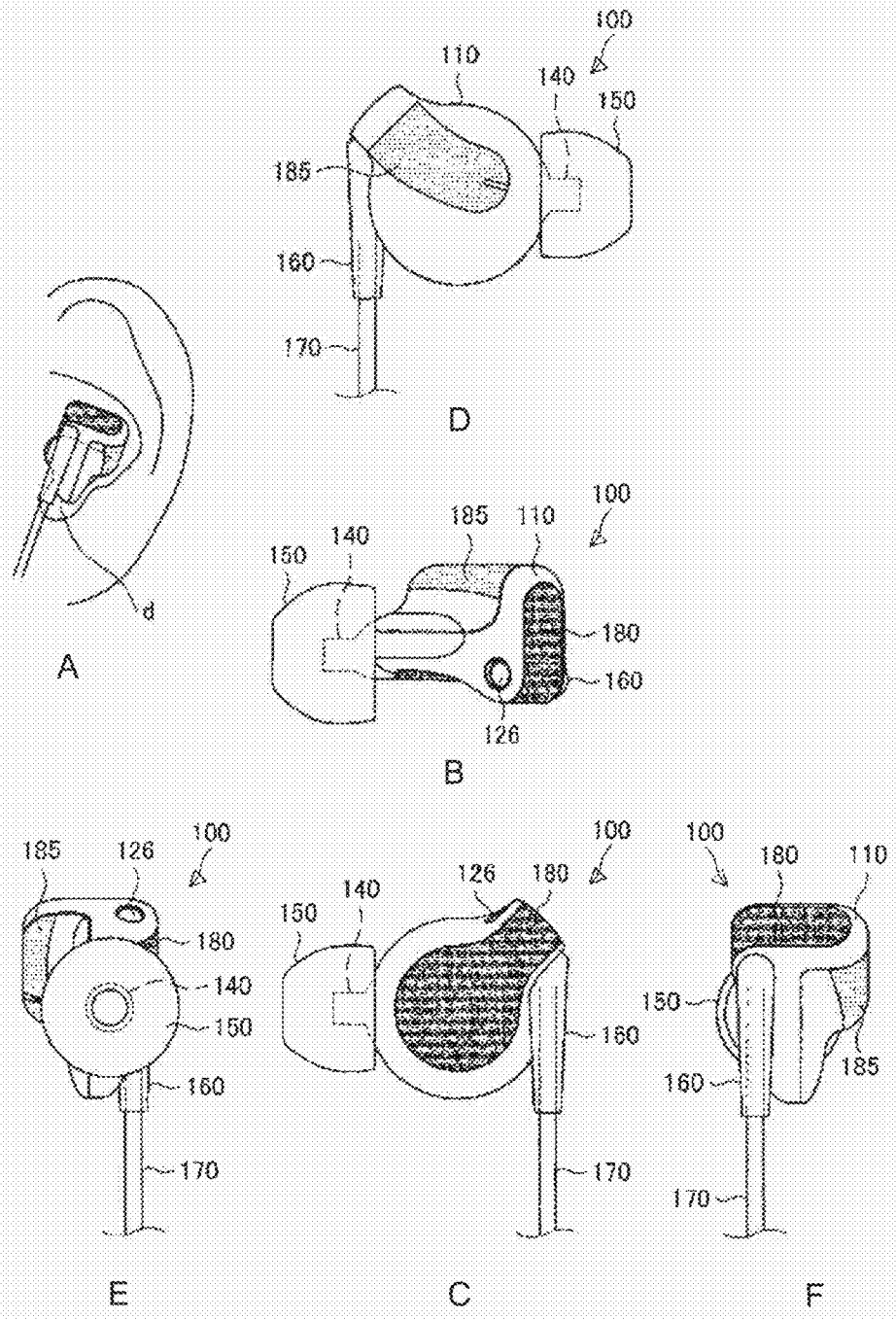
FIG. 1 shows an electro-acoustic transducer according to an embodiment of the present technology, in which Section A is a view showing a fitted state in a left ear of a user, Section B is a perspective view as viewed from a back direction, Section C is a side view, Section D is a back view, Section E is a front view, and Section F is a back view.

Sections A to F of FIG. 1 show a configuration of an earphone as an electro-acoustic transducer. In this embodiment, descriptions will be given using an earphone for mainly playing music tracks as an example. The earphone is typically configured as a pair of earphones and, in use, fitted in right and left ears of a user.

Section A of FIG. 1 is a view of a fitted state of an earphone 100 fitted in the left ear of the user. Section B of FIG. 1 is a perspective view of the earphone 100 as viewed from a back direction. Sections C to F of FIG. 1 show the entire earphone 100. Section C of FIG. 1 is a right side view, Section D of FIG. 1 is a left side view, Section E of FIG. 1 is a front view, and Section F of FIG. 1 is a back view.

The earphone 100 includes an almost disk-shaped housing 110, an almost cylindrical sound guide tube 140 provided projecting from the housing 110, and an earpiece 150 attached to an end of the sound guide tube 140. Further, the earphone 100 includes a bushing 160 provided on a rear side and a cable 170 retained by the bushing 160.

The housing 110 is partially covered with an anterior cap 180 bent in an almost L-shape and a posterior cap 185 having an almost semi-cylindrical shape. The housing 110 is made of light-weight and strong material, such as magnesium, for reducing the size and thickness of a casing.

Figure 2:
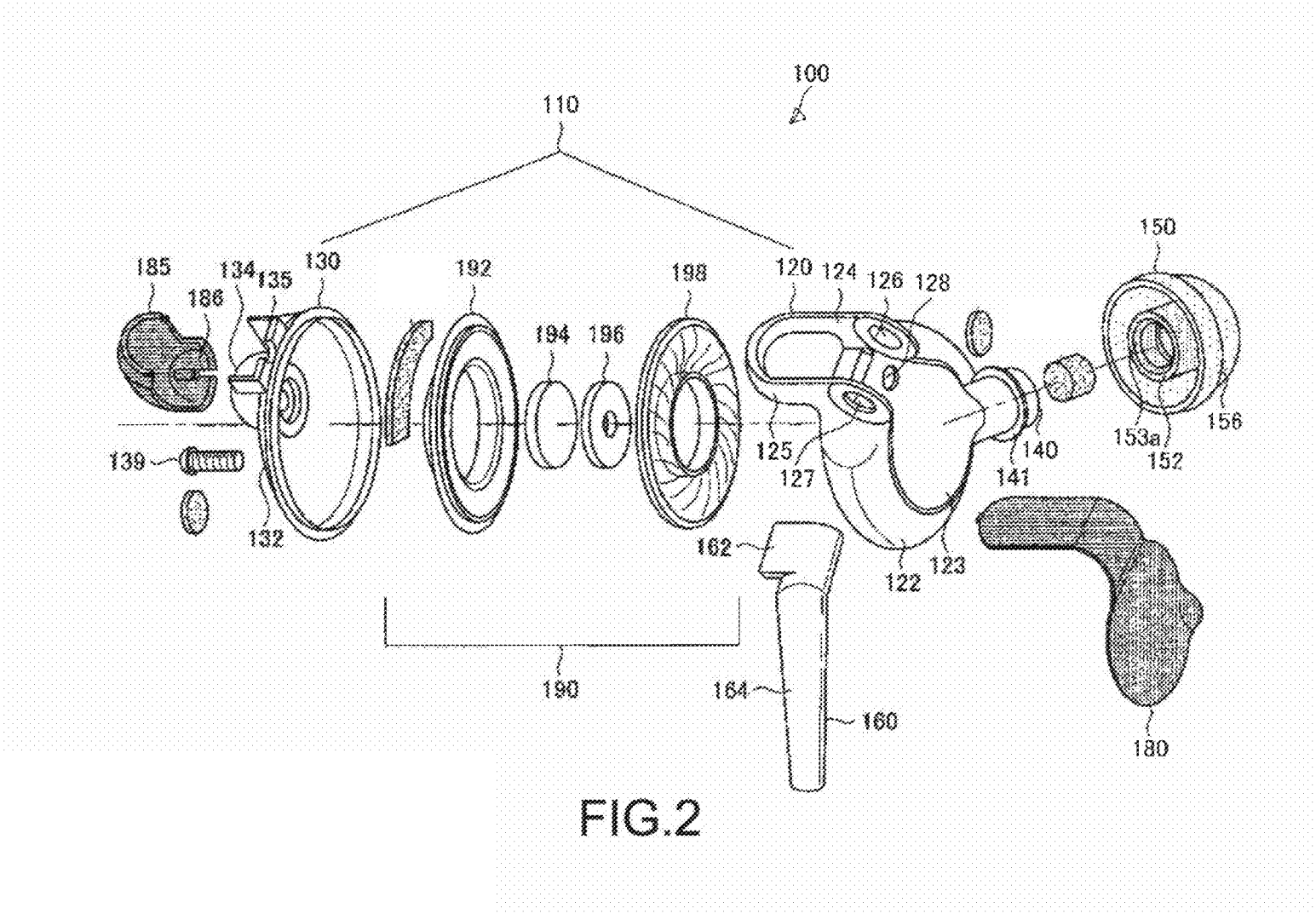
FIG. 2 is an exploded perspective view of the electro-acoustic transducer.

FIG. 2 is an exploded perspective view of the earphone 100.

The housing 110 houses a driver unit 190 including a diaphragm 198 (electro-acoustic transducer element) and forms a space surrounding an anterior surface of the diaphragm 198. The driver unit 190 drives the diaphragm 198 according to an audio signal supplied via the cable 170, to thereby generate air vibrations in a space in front of the diaphragm 198. Note that, in an upper surface of the housing 110, there is provided an air hole 126 for putting the space in front of the diaphragm 198 in communication with an outside of the housing 110.

The sound guide tube 140 is formed integrally with the housing 110 to protrude to the front side of the earphone 100. The sound guide tube 140 is to be inserted into the ear canal with the earpiece 150 in contact therewith. The sound guide tube 140 guides air vibrations generated by the driver unit 190 to the ear canal as acoustic waves in an audible range corresponding to an audio signal.

The earpiece 150 is made of elastic material such as silicone rubber, urethane, NBR (nitrile rubber), and elastomer. The earpiece 150 is deformed according to the shape of the ear canal of the user such that the ear canal retains the housing 110 in close contact with the ear canal.

The bushing 160 is made of elastic material such as elastomer. The bushing 160 fixes, with respect to the housing 110, a pullout position of the cable 170 connected to the driver unit 190. The bushing 160 extends from the rear side of the housing 110 to avoid contact with an auricle, and when the earphone 100 is fitted in the ear, the bushing 160 points downward almost vertically such that the user can pinch it by fingers.

The anterior cap 180 is made of stainless steel or the like, and the posterior cap 185 is made of plastic or the like. The anterior cap 180 and the posterior cap 185 protect the housing 110, the cable 170, air holes 128 and 136, and the like.

Figure 3:
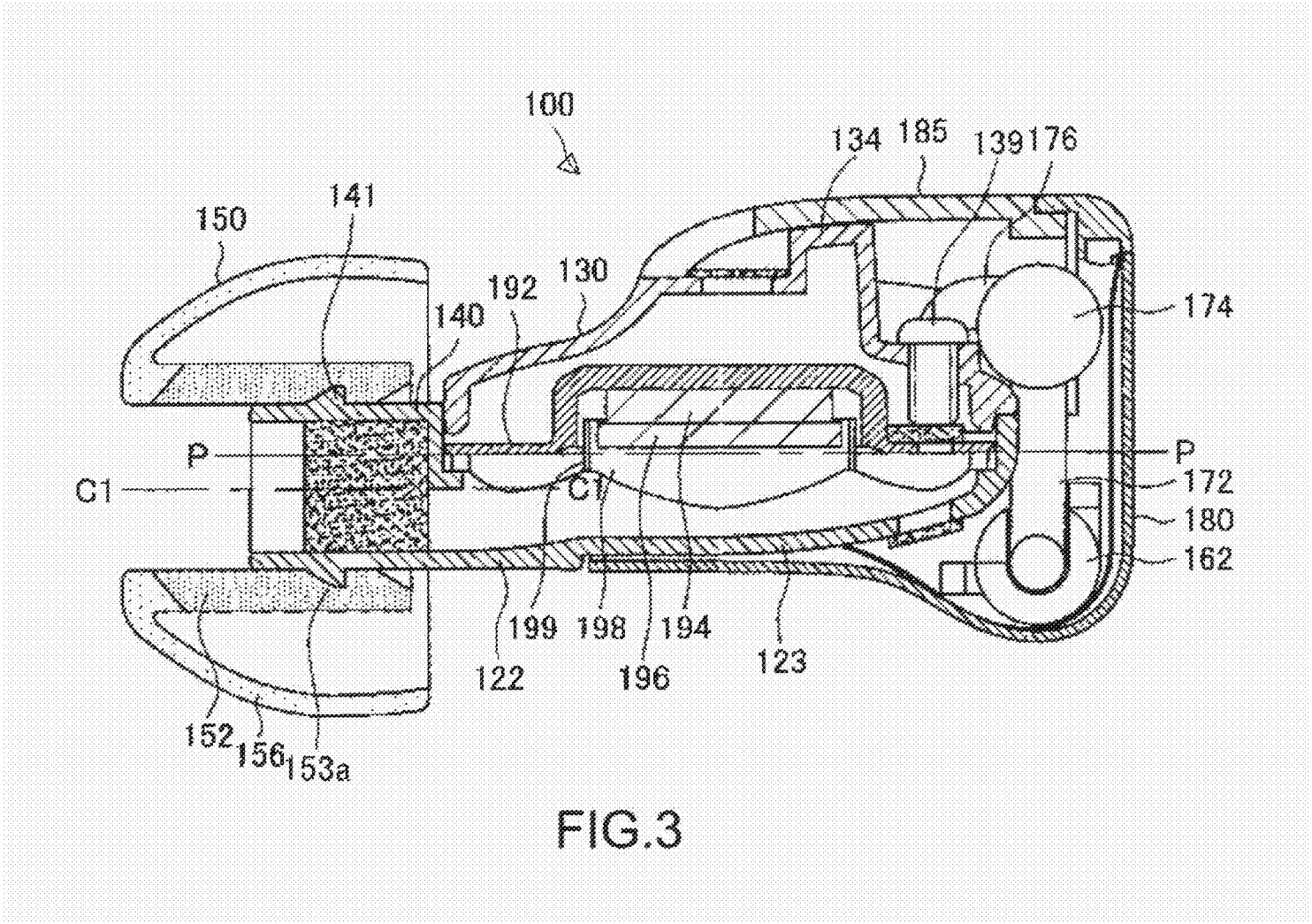
FIG. 3 is a longitudinal cross-sectional view of the electro-acoustic transducer.

Next, an internal configuration of the earphone 100 will be described. FIG. 3 is a longitudinal cross-sectional view of the earphone 100 taken along a section that is perpendicular to a fitted surface P of the diaphragm 198 and includes a central axis Cl of the sound guide tube 140.

As shown in FIGS. 2 and 3, the housing 110 is configured by an anterior housing 120 and a posterior housing 130, each of which has an almost bowl shape. The housing 110 is formed by bonding the anterior housing 120 and the posterior housing 130 by ultrasonic welding, for example, with the driver unit 190 placed inside.

The anterior housing 120 includes an almost bowl-shaped anterior portion 122, the sound guide tube 140 that protrudes from a part of the side wall that forms the anterior portion 122, and a bending portion 124 that bends from another part of the side wall. When the earphone 100 is fitted in the ear, the anterior portion 122 is disposed on almost the front side of the user, the sound guide tube 140 is disposed almost concentrically with the ear canal of the user, and the bending portion 124 is disposed on almost the side of the user.

The anterior portion 122 has a depressed portion 123 in the part corresponding to a bowl bottom and further has an air hole 128 in the vicinity of the boundary with the bending portion 124. The sound guide tube 140 has a ring-shaped engaging projecting portion 141. The bending portion 124 has a side wall 125 in a flat U-shape as viewed from the side of the user, which protrudes from a side wall that forms the anterior portion 122. The bending portion 124 has a space that is surrounded by the side wall 125 in order to house the bushing 160, the cable 170, and the like. The side wall 125 has the air hole 126 and a bushing attachment hole 127 in the part near the boundary with the anterior portion 122.

The posterior housing 130 includes an almost bowl-shaped posterior portion 132 and a curving portion 134 with a side wall 135 in a flat curve shape vertically formed in a part of the area corresponding to a bowl bottom. The curving portion 134 has a space that is surrounded by the side wall 135 in order to house the cable 170. When the earphone 100 is fitted in the ear, the posterior portion 132 is disposed on almost the rear side of the user and the curving portion 134 is disposed in the upper space of an antitragus without contact with the auricle of the user. The posterior portion 132 that is positioned below the curving portion 134 is disposed in an incisura intertragica d (see Section A of FIG. 1) together with the anterior portion 122 that is positioned below the bending portion 124.

The posterior portion 132 has the shape almost corresponding to the anterior portion 122. The space formed by the side wall 135 of the curving portion 134 has almost the same width as the space formed by the side wall 125 of the bending portion 124, and the two spaces are connected to form one space.

The earpiece 150 includes an attachment portion 152 that is attached to the sound guide tube 140, a fitting portion 156 that is formed continuously from the end of the attachment portion 152 to the outside to form a space around the attachment portion 152, and an engaging depressed portion 153*a* that is formed in the attachment portion 152 to be engaged to the engaging projecting portion 141 of the sound guide tube 140. The earpiece 150 is inserted into the ear canal almost concentrically with the ear canal and fitted in the ear canal with the fitting portion 156 in contact therewith.

The bushing 160 includes an attachment portion 162 and a cable fixing portion 164 that extends from the attachment portion 162. The attachment portion 162 is attached to the bushing attachment hole 127 in the bending portion 124 of the anterior housing 120 such that it is slightly rotatable. The cable fixing portion 164 fixes, with respect to the housing 110, the pullout position of the cable 170 connected to the driver unit 190.

The anterior cap 180 covers the space formed by the depressed portion 123 of the anterior housing 120 and the side wall 125 of the bending portion 124. The posterior cap 185 covers the space formed by the side wall 135 of the curving portion 134 of the posterior housing 130 in connection with the bending portion 124 of the anterior housing 120, and it has an air hole 186 at its end. Further, the anterior cap 180 and the posterior cap 185 are formed to cover the air holes 128 and 136 of the anterior housing 120 and the posterior housing 130, respectively.

As shown in FIG. 3, the cable 170 is disposed on the rear side of the anterior housing 120 through the attachment portion 162 of the bushing 160 that is disposed in the space that is formed by the side wall 125 of the anterior housing 120. The cable 170 is pulled into the space that is formed by the side wall 135 of the posterior housing 130, and connected to a cable 176 on the driver unit 190 side via a knot 174. Further, the anterior cap 180 and the posterior cap 185 are fitted onto the anterior housing 120 and the posterior housing 130, respectively, to thereby protect the bushing 160 and the cable 170 that are disposed on the rear side of the housing 110.

The driver unit 190 is constituted of a frame 192, a magnet 194, a pole piece 196, and the diaphragm 198. In the driver unit 190, the diaphragm 198 that includes a voice coil 199 is disposed in a magnetic circuit that is configured by the magnet 194, and the diaphragm 198 is driven according to an audio signal that is supplied to the voice coil 199 through the cable 170. The driver unit 190 is integrated with the housing 110 in a state in which it is placed between the anterior housing 120 and the posterior housing 130 with the frame 192 interposed therebetween, to thereby reduce unnecessary vibrations and improve the sound quality in the low frequency range. In a state in which the driver unit 190 is housed in the housing 110, there is a space on each of the anterior side and the posterior side of the driver unit 190.

[Earpiece]

Figure 4:
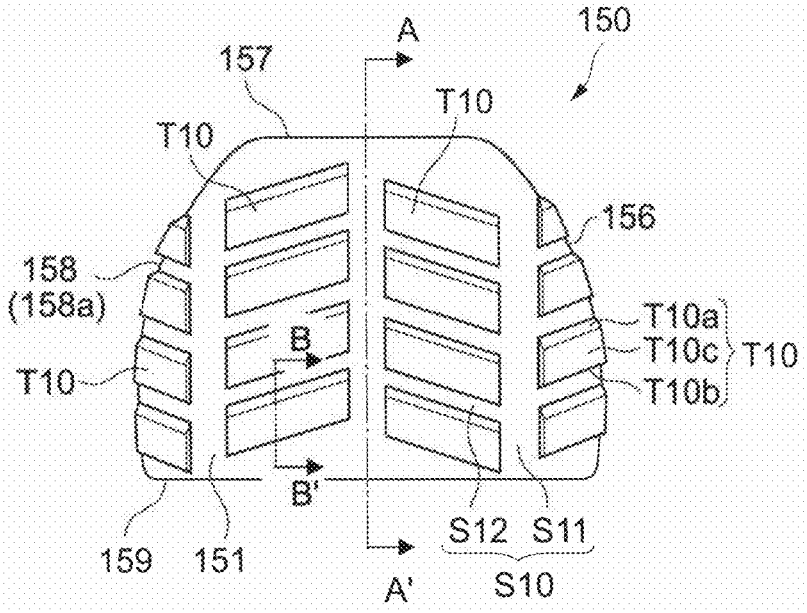
FIG. 4 is a side view of an earpiece according to a first embodiment of the present technology.

Next, details of the earpiece 150 will be described. FIG. 4 is a side view of the earpiece 150, FIG. 5 is a cross-sectional view taken along the line A-A' of FIG. 4, and FIG. 6 is a perspective view showing an outer appearance of the earpiece 150.

Figure 5:
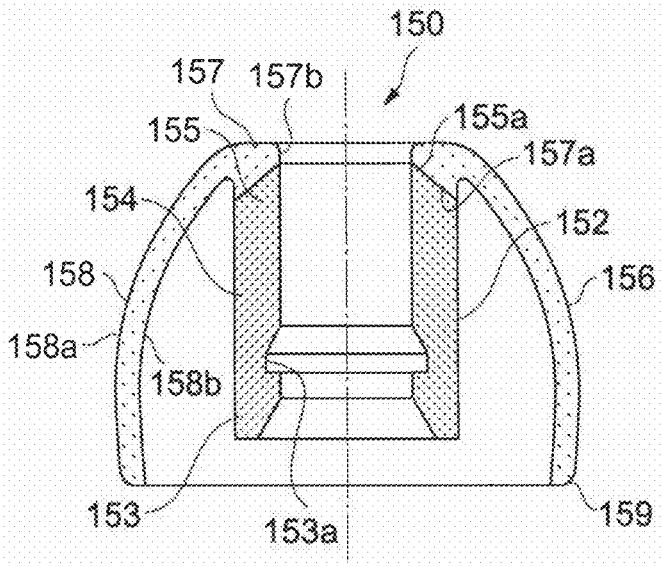
FIG. 5 is a cross-sectional view taken along the line A-A' of FIG. 4.
Figure 6:
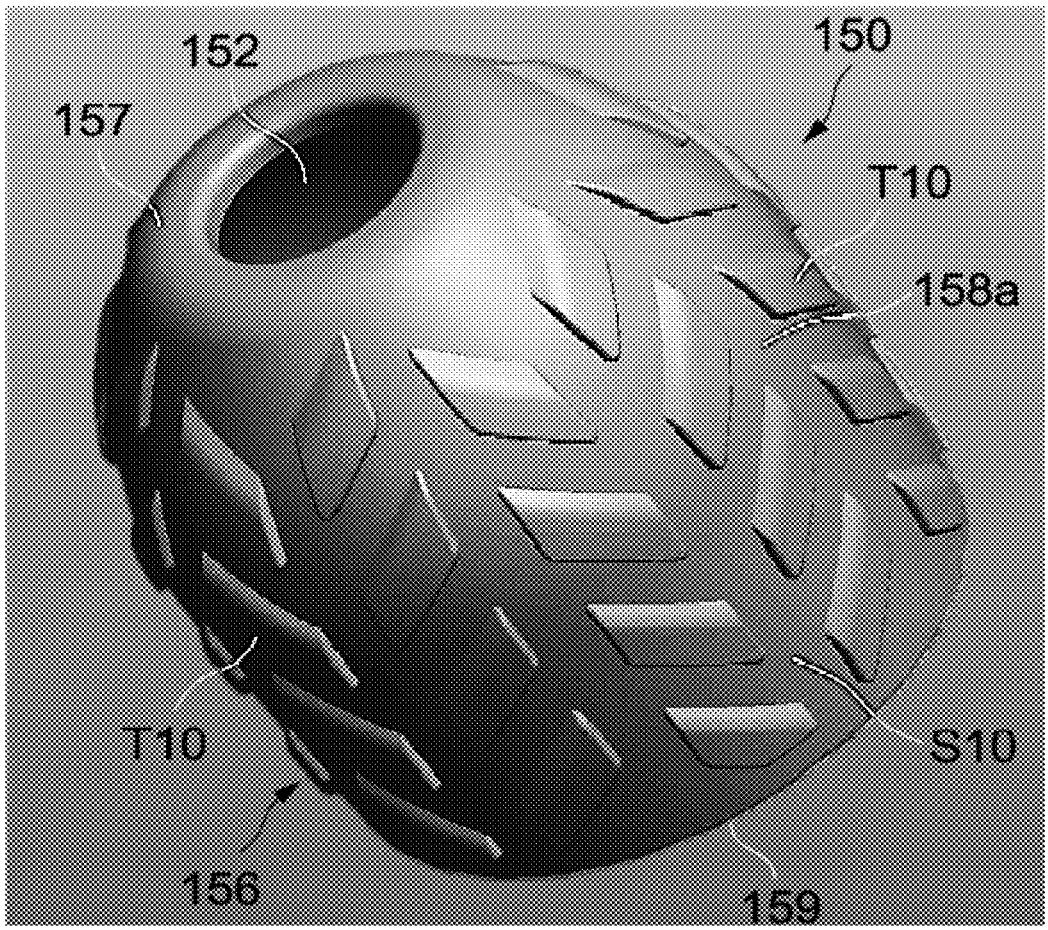
FIG. 6 is a perspective view showing an outer appearance of the earpiece.

As shown in FIG. 5, the earpiece 150 includes the attachment portion 152 and the fitting portion 156.

The attachment portion 152 is disposed inside the almost cap-shaped fitting portion 156. The attachment portion 152 is engaged to the sound guide tube 140 that is formed protruding from the earphone 100. The attachment portion 152 is formed extending to an output direction of an acoustic wave. The attachment portion 152 is configured by a cylindrical shaft portion and includes an attachment end 153 attached to the sound guide tube 140, an output portion 154 that outputs an acoustic wave guided through the sound guide tube 140, and an end portion 155 located at the end of the output portion 154.

The attachment portion 153 has the engaging depressed portion 153*a* to be engaged to the engaging projecting portion 141 that is formed on the periphery of the sound guide tube 140. The end portion 155 includes an end surface 155*a* having a shape corresponding to a connecting surface 157*a* provided at a first end 157 of the fitting portion 156. The attachment portion 152 and the fitting portion 156 are molded in one piece via the end surface 155*a* and the connecting surface 157*a*.

The fitting portion 156 is formed continuously from the end surface 155*a* of the attachment portion 152 to the outside of the attachment portion 152 to form a space around the attachment portion 152. With this, the fitting portion 156 is deformed according to the shape of the auricle, a change in the fitted position, and so on, to thereby further improve the fitting properties with the ear canal.

The fitting portion 156 includes the first end 157, a cap portion 158, and a second end 159.

The first end forms an end of the earpiece 150 and includes the connecting surface 157*a* that is connected to the attachment portion 152 and an opening portion 157*b* for opening an inside of the attachment portion 152. The second end 159 forms a periphery of the cap portion 158 on an opposite side of the first end 157.

The cap portion 158 is formed continuously from the first end 157 and disposed outside the attachment portion 152 to surround the attachment portion 152. An aperture of the cap portion 158 with respect to a central axis of the earpiece 150 gradually increases from the first end 157 to the second end 159. The cap portion 158 includes an outer surface 158*a* in contact with the ear canal and an inner surface 158*b* that is opposed to the attachment portion 152 when the earpiece 150 is fitted in the ear.

As shown in FIG. 4, the outer surface 158*a* of the cap portion 158 includes the passage S10 that connect the first end 157 and the second end 159 to each other. The passage S10 is a depressed passage provided in the outer surface 158*a* of the cap portion 158 and mainly functions to discharge moisture such as sweat and sebum in the ear canal from the first end 157 to the second end 159.

The passage S10 includes a plurality of first passage portions S11 and a plurality of second passage portions S12. The plurality of first passage portions S11 are formed along an axial direction of the fitting portion 156. The plurality of second passage portions S12 are formed along a circumferential direction of the fitting portion 156 and connect the plurality of first passage portions S11 to one another.

In this embodiment, the passage S10 is formed among a plurality of protrusions T10 provided in the outer surface 158*a* of the cap portion 158. Each of the protrusions T10 has an outer appearance shape like a flat rectangular depression. The protrusions T10 are arranged at appropriate intervals in the axial direction and the circumferential direction of the fitting portion 156. First passage portions S11 and second passage portions S12 are formed among the protrusions T10. The plurality of protrusions T10 are arranged over the entire outer surface 158*a* of the cap portion 158 with a predetermined density.

Each of the plurality of protrusions T10 is generally formed in an almost parallelogram shape. Both edge potions on a long side are inclined with respect to the axial direction of the fitting portion 156 and both edge portions on a short side are parallel to the axial direction of the fitting portion 156. In this embodiment, the protrusions T10 are aligned in the axial direction of the fitting portion 156. The protrusions T10 in each of adjacent rows are arranged in the circumferential direction of the fitting portion 156 while alternately inverting the inclination direction of the edge portions on the long side. Although the plurality of protrusions T10 have almost the same size and shape, some of the protrusions T10 located on the second end 159 side of the fitting portion 156 are formed in a rectangular shape unlike the other protrusions T10.

Figure 7:
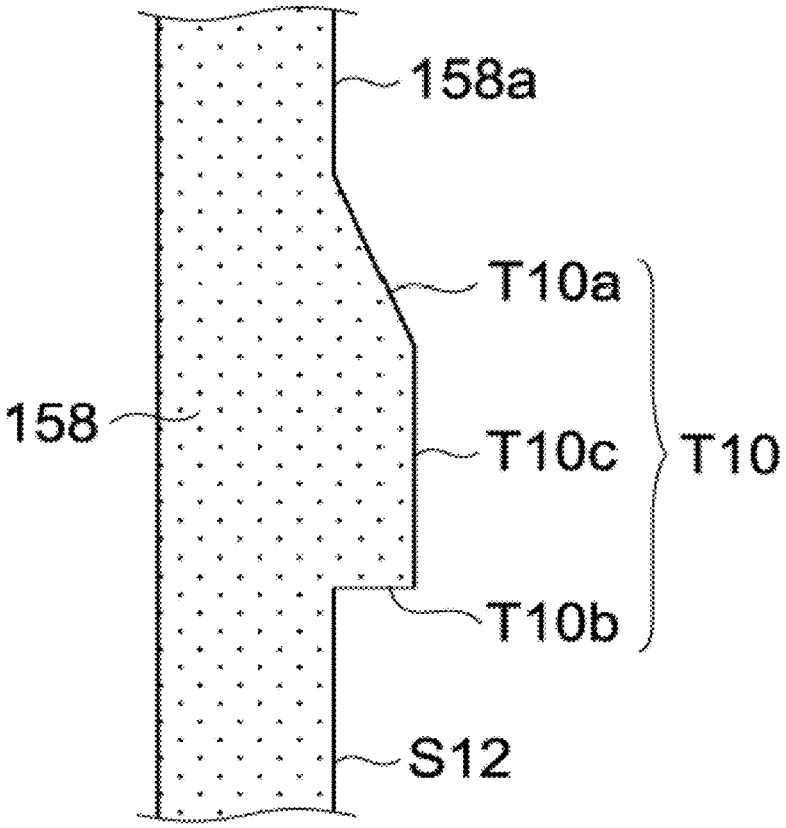
FIG. 7 is a cross-sectional view taken along the line B-B' of FIG. 4.

FIG. 7 is a cross-sectional view of the fitting portion 156 taken along the line B-B' of FIG. 4.

Each of the plurality of protrusions T10 includes a first edge portion T10*a*, a second edge portion T10*b*, and a flat portion T10*c* formed therebetween. The first edge portion T10*a* is an edge portion on the long side of the protrusion T10 that is located on the first end 157 side and formed in a taper shape to be inclined upwards to the flat portion T10*c*. On the other hand, the second edge portion T10*b* is an edge portion on the long side of the protrusion T10 that is located on the second end 159 side and formed in an edge shape cut perpendicularly or in an inverse taper shape from the flat portion T10*c* to the outer surface 158*a* of the cap portion 158.

The plurality of protrusions T10 are formed integrally with the outer surface 158*a* of the cap portion 158. Thus, the plurality of protrusions T10 are made of elastic material identical to that of the cap portion 158, and configured to be appropriately deformable when they are fitted in the ear canal.

The protruding amount of the protrusions T10 from the outer surface 158*a* of the cap portion 158, the arrangement intervals of the protrusions T10, and the like are not particularly limited. The protrusions T10 are formed with a size capable of giving a predetermined fitting feeling to the ear canal and providing a passage width with which moisture in the ear canal can be suitably received.

The earpiece 150 having the above-mentioned configuration according to this embodiment is inserted into the ear canal from the first end 157 and thus fitted in the ear canal. At this time, the fitting portion 156 is elastically deformed flexibly according to the shape of the ear canal and the plurality of protrusions T10 provided in the outer surface 158*a* of the cap portion 158 are brought into close contact with an inner wall surface of the ear canal, and thus a stable fitting feeling can be given.

According to this embodiment, the first edge portions T10*a* of the protrusions T10 have a taper shape, and hence the fitting properties of the earpiece 150 to the ear canal can be improved.

The earpiece 150 in this embodiment includes the passage S10 in the outer surface 158*a* of the cap portion 158, and hence moisture such as sweat and sebum between the outer surface of the fitting portion 156 and the inner wall surface of the ear canal is guided into the passage S10, to thereby suppress a reduction in frictional force between the fitting portion 156 and the ear canal. This can make it difficult for the earpiece 150 to fall out of the ear in sports, for example.

According to this embodiment, the first passage portions S11 and the second passage portions S12 form the passage S10 in a net or grid form over almost the entire outer surface of the fitting portion 156, and hence it is possible to efficiently guide moisture in the ear canal into the passage S10. With this, formation of a film of the above-mentioned moisture between the surface of the fitting portion 156 and the inner surface of the ear canal can be suppressed as much as possible, to thereby secure a stable fitting feeling.

Further, in the earpiece 150 according to this embodiment, the passage S10 is formed to connect the first end 157 and the second end 159 of the fitting portion 156 to each other, and hence, when the earpiece 150 is inserted into the ear canal, moisture adhering to the inner wall of the ear canal can be discharged from the first end 157 to the second end 159 via the passage S10. With this, it becomes possible to give a comfortable fitting feeling without needing a work to wipe off moisture on the fitting portion surface and to keep a stable fitted state. In addition, the second passage portions S12 are formed obliquely from the first end 157 to the second end 159, and hence it is possible to enhance the effect of discharging moisture from the ear canal.

In addition, the second edge portions T10*b* of the protrusions T10 are formed in an edge shape, and hence, when the earpiece 150 is pulled out from the ear canal, an action of scraping off moisture adhering to the inner surface of the ear canal by the second edge portions T10*b* of the protrusions T10 can be provided. Thus, it is possible to efficiently discharge moisture such as sweat and sebum remaining in the ear canal every time the earpiece 150 is fitted in the ear canal, and hence a comfortable fitting feeling can be easily maintained.

In addition, according to this embodiment, the passage S10 can function as a sound path through which the external sounds pass. With this, also while the earpiece 150 is being fitted in the ear, the user can hear surrounding sounds.

<Second Embodiment>

Figure 8:
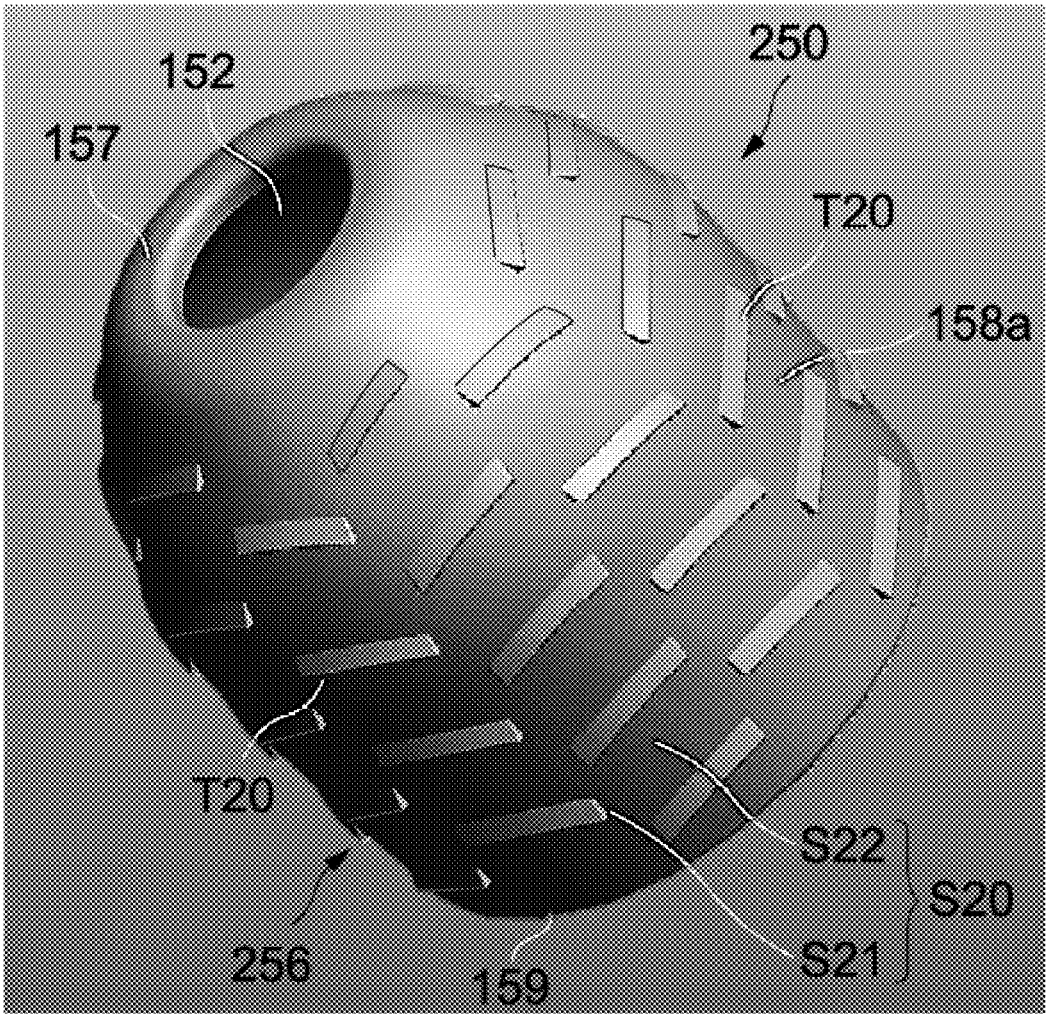
FIG. 8 is a perspective view showing an outer appearance of an earpiece according to a second embodiment of the present technology.

FIG. 8 is a perspective view showing an outer appearance of an earpiece according to a second embodiment of the present technology. Hereinafter, components different from those of the first embodiment will be mainly described, and the same components as those of the above-mentioned embodiment will be denoted by the same reference symbols and descriptions thereof will be omitted or simplified.

An earpiece 250 according to this embodiment includes a fitting portion 256 and an attachment portion 152 disposed inside the fitting portion 256. The fitting portion 256 corresponds to the fitting portion 156 described in the first embodiment and includes a first end 157, a second end 159, and an outer surface 158*a* including a passage S20 that connects the first end 157 and the second end 159 to each other.

The passage S20 is formed among a plurality of protrusions T20. As in the first embodiment, the plurality of protrusions T20 are arranged at predetermined intervals in an axial direction and a circumferential direction of the fitting portion 256. In this embodiment, the plurality of protrusions T20 have a longitudinal direction in the circumferential direction of the fitting portion 256 and are formed in an almost triangular prism shape including oblique sides on the first end 157 side.

Figure 9:
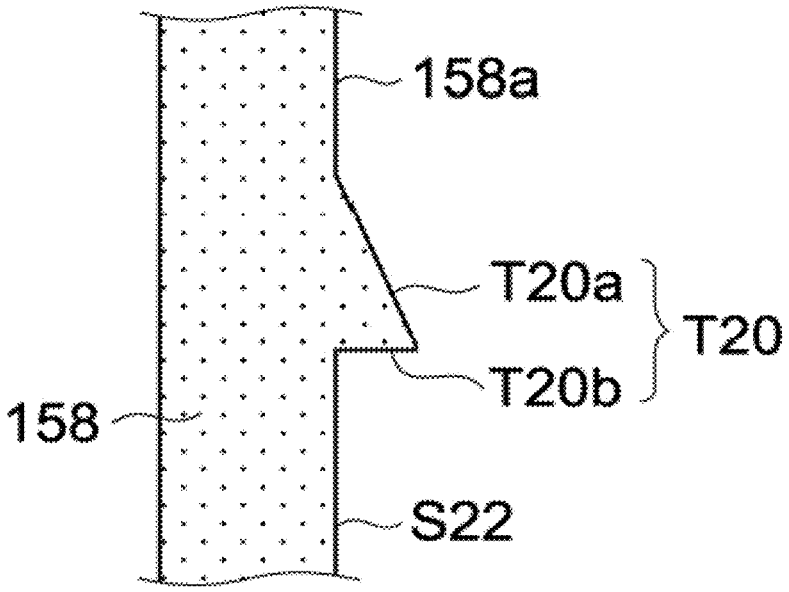
FIG. 9 is a schematic cross-sectional view of main parts of FIG. 8.

FIG. 9 is a schematic cross-sectional view of one of the protrusions T20. The protrusion T20 includes a first edge portion T20*a* having a taper shape formed on the first end 157 side and a second edge portion T20*b* having an edge shape formed on the second end 159 side. That is, the protrusion T20 has a shape obtained by omitting a flat portion T10*c* in the protrusion T10 described in the first embodiment.

Also with the earpiece 250 having the above-mentioned configuration according to this embodiment, the same action and effect as those of the first embodiment can be provided.

<Third Embodiment>

Figure 10:
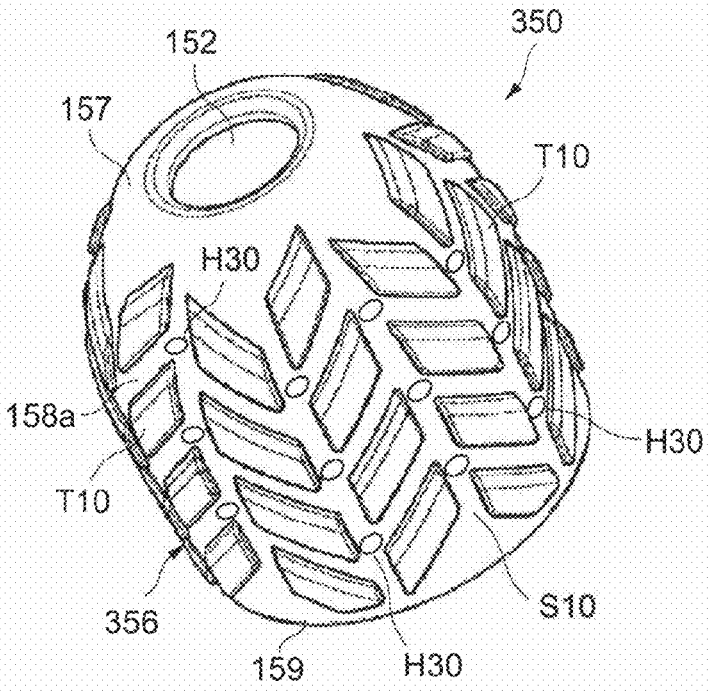
FIG. 10 is a perspective view showing an outer appearance of an earpiece according to a third embodiment of the present technology.

FIG. 10 is a perspective view showing an outer appearance of an earpiece according to a third embodiment of the present technology. Hereinafter, components different from those of the first embodiment will be mainly described, and the same components as those of the above-mentioned embodiment will be denoted by the same reference symbols and descriptions thereof will be omitted or simplified.

The earpiece 350 according to this embodiment includes a fitting portion 356 and an attachment portion 152 disposed inside the fitting portion 356. The fitting portion 356 corresponds to the fitting portion 156 described in the first embodiment and includes a first end 157, a second end 159, and an outer surface 158*a* including a passage S10 that connect the first end 157 and the second end 159 to each other.

Figure 11:
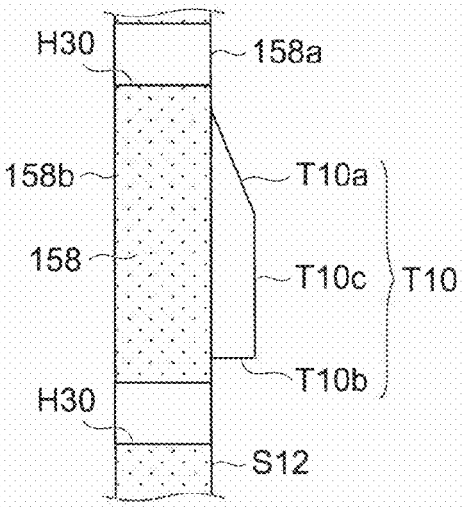
FIG. 11 is a schematic cross-sectional view of main parts of FIG. 10.

In this embodiment, the fitting portion 356 includes a plurality of through-holes H30 provided in the passage S20. FIG. 11 is a partial cross-sectional view of the passage S20.

The through-holes H30 are formed to connect the outer surface 158*a* and the inner surface 158*b* of the cap portion 158. The through-holes H30 are not limited to the exemplary round holes as shown in the figure and may be formed as various other shapes such as long holes, oval holes, and square holes. Although the size of the through-holes H30 is not particularly limited, the through-holes H30 are formed having such a size that moisture such as sweat can be passed therethrough.

Also with the earpiece 350 having the above-mentioned configuration according to this embodiment, the same action and effect as those of the first embodiment can be provided. Further, according to this embodiment, the passage S10 has the plurality of through-holes H30, and hence it becomes possible to discharge moisture received in the passage S10 to the inner surface 158*b* of the cap portion 158. With this, it is possible to improve the discharging properties of the passage S10 and further improve the fitting feeling.

<Fourth Embodiment>

Figure 12:
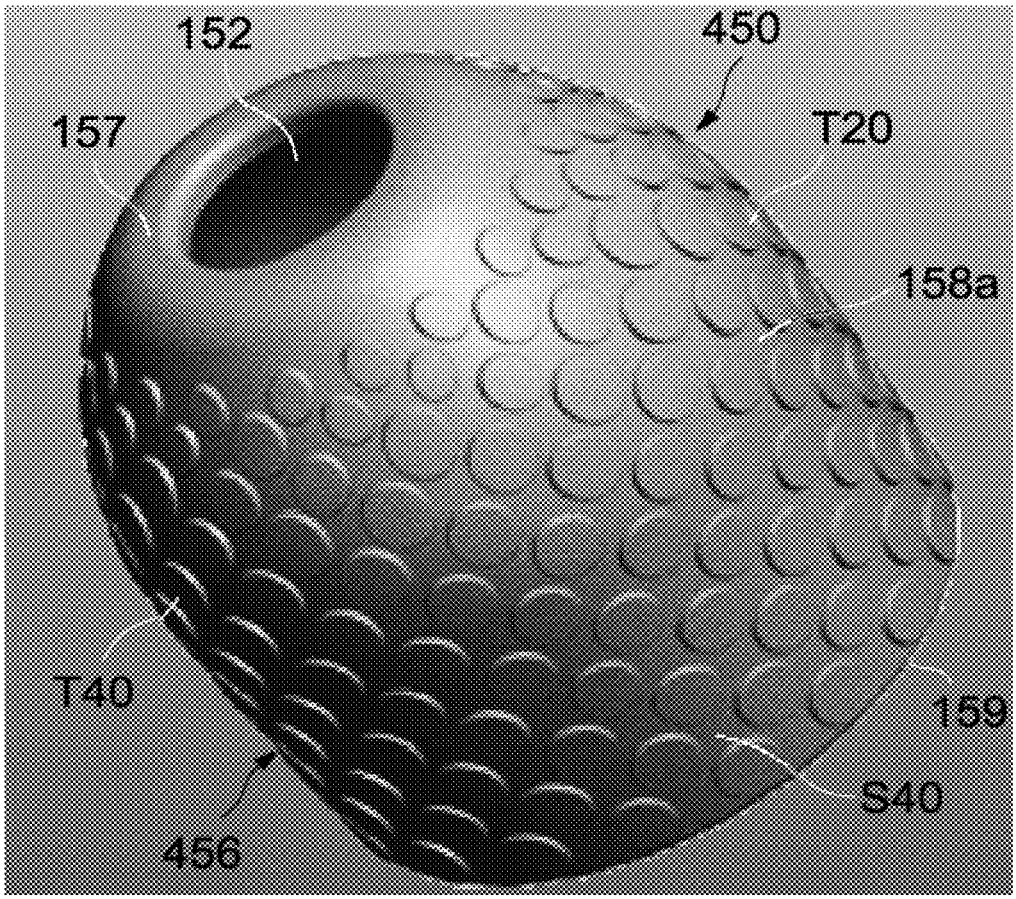
FIG. 12 is a perspective view showing an outer appearance of an earpiece according to a fourth embodiment of the present technology.

FIG. 12 is a perspective view showing an outer appearance of an earpiece according to a fourth embodiment of the present technology. Hereinafter, components different from those of the first embodiment will be mainly described, and the same components as those of the above-mentioned embodiment will be denoted by the same reference symbols and descriptions thereof will be omitted or simplified.

An earpiece 450 according to this embodiment includes a fitting portion 456 and an attachment portion 152 disposed inside the fitting portion 456. The fitting portion 456 corresponds to the fitting portion 156 described in the first embodiment and includes a first end 157, a second end 159, and an outer surface 158*a* including a passage S40 that connect the first end 157 and the second end 159 to each other.

The passage S40 is formed among a plurality of protrusions T40. As in the first embodiment, the plurality of protrusions T40 are arranged at predetermined intervals in an axial direction and a circumferential direction of the fitting portion 456. In this embodiment, the plurality of protrusions T40 are formed in an almost disc shape. The passage S40 connects the first end 157 and the second end 159 to each other, threading its way through the plurality of protrusions T40.

Also with the earpiece 450 having the above-mentioned configuration according to this embodiment, the same action and effect as those of the first embodiment can be provided.

<Fifth Embodiment>

Figure 13:
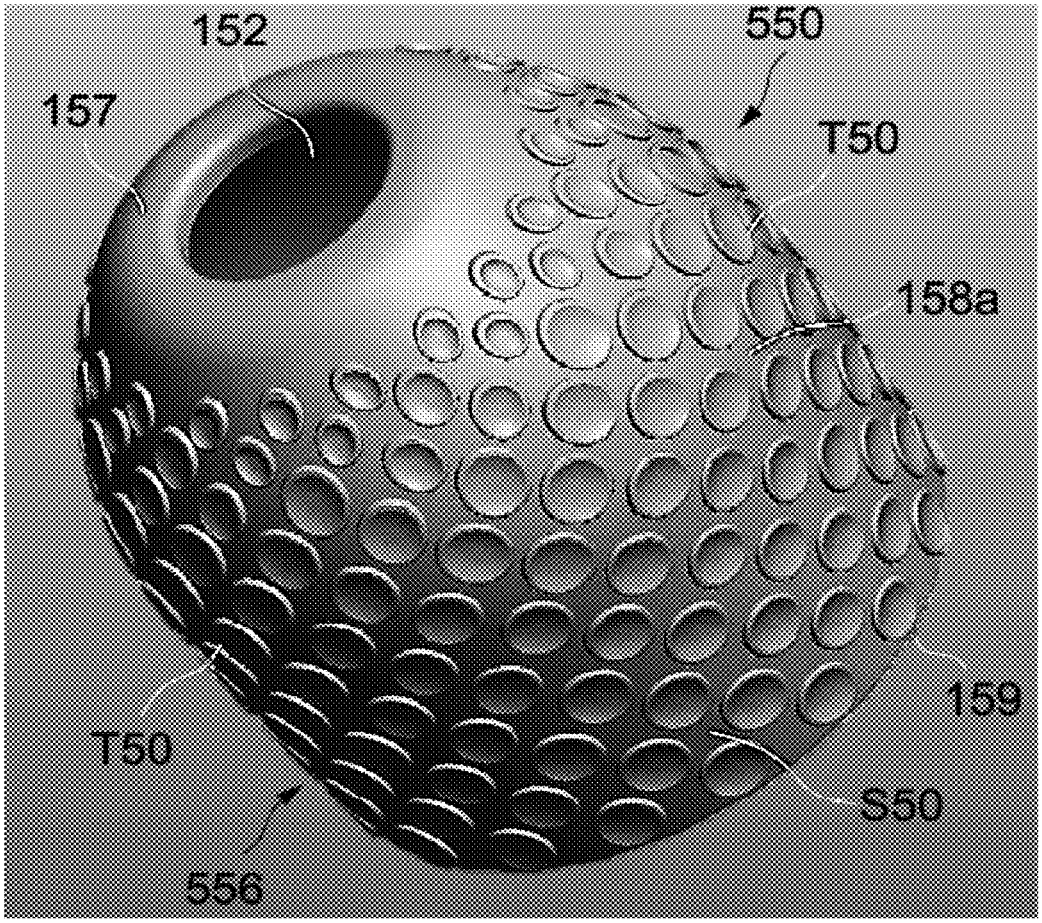
FIG. 13 is a perspective view showing an outer appearance of an earpiece according to a fifth embodiment of the present technology.

FIG. 13 is a perspective view showing an outer appearance of an earpiece according to a fifth embodiment of the present technology. Hereinafter, components different from those of the first embodiment will be mainly described, and the same components as those of the above-mentioned embodiment will be denoted by the same reference symbols and descriptions thereof will be omitted or simplified.

An earpiece 550 according to this embodiment includes a fitting portion 556 and an attachment portion 152 disposed inside the fitting portion 556. The fitting portion 556 corresponds to the fitting portion 156 described in the first embodiment and includes a first end 157, a second end 159, and an outer surface 158*a* including a passage S50 that connect the first end 157 and the second end 159 to each other.

A passage S40 is formed among a plurality of protrusions T50. As in the first embodiment, the plurality of protrusions T50 are arranged at predetermined intervals in an axial direction and a circumferential direction of a fitting portion 456. In this embodiment, the plurality of protrusions T50 are formed in an almost annular sucker shape. The passage S50 connects the first end 157 and the second end 159 to each other, threading its way through the plurality of protrusions T50.

Also with the earpiece 550 having the above-mentioned configuration according to this embodiment, the same action and effect as those of the first embodiment can be provided. Further, according to this embodiment, the plurality of protrusions T50 have the sucker shape, and hence it is possible to increase the close-contact property between the fitting portion 556 and the ear canal and give a stable fitting feeling. Further, inner depressed parts of the protrusions that form the suckers may also function as spaces for receiving moisture in the ear canal.

<Sixth Embodiment>

Figure 14:
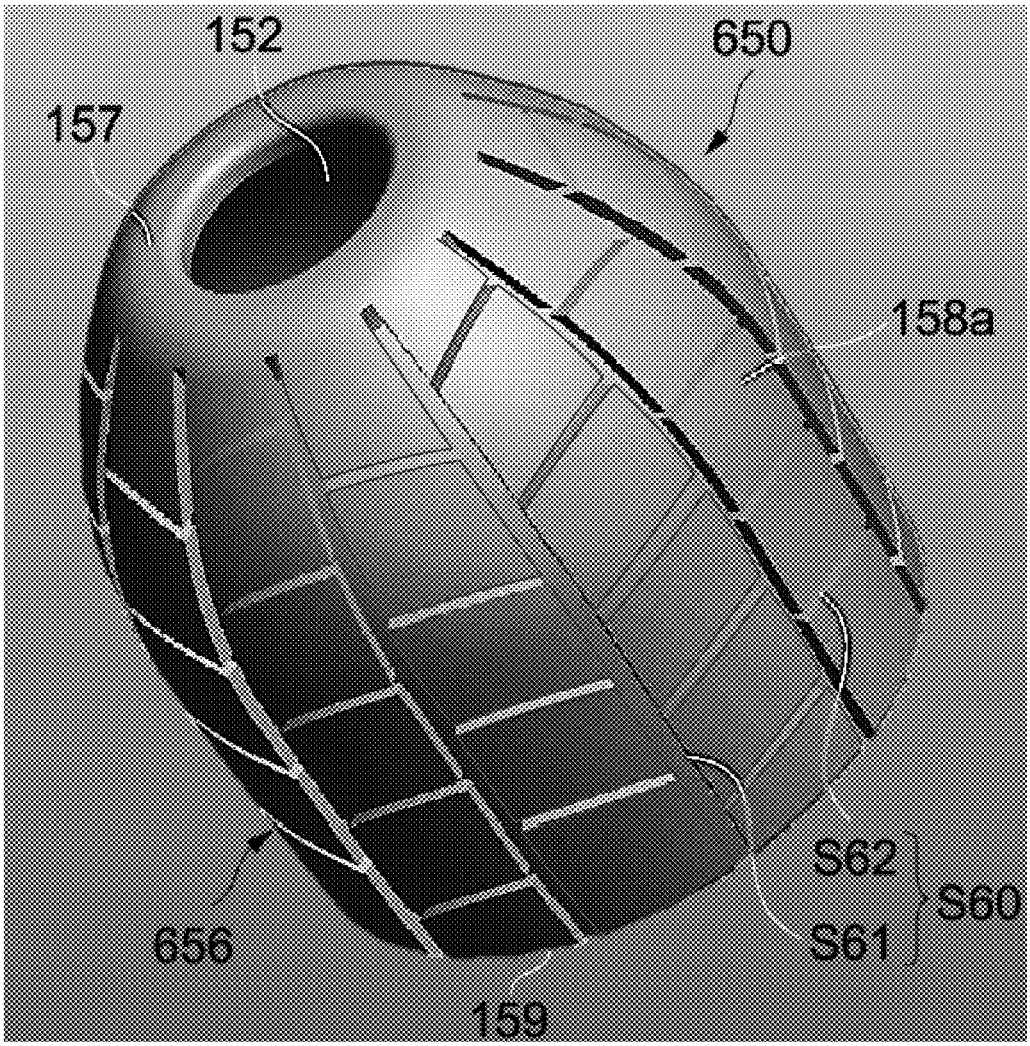
FIG. 14 is a perspective view showing an outer appearance of an earpiece according to a sixth embodiment of the present technology.

FIG. 14 is a perspective view showing an outer appearance of an earpiece according to a sixth embodiment of the present technology. Hereinafter, components different from those of the first embodiment will be mainly described, and the same components as those of the above-mentioned embodiment will be denoted by the same reference symbols and descriptions thereof will be omitted or simplified.

An earpiece 650 according to this embodiment includes a fitting portion 656 and an attachment portion 152 disposed inside the fitting portion 656. The fitting portion 656 corresponds to the fitting portion 156 described in the first embodiment and includes a first end 157, a second end 159, and an outer surface 158*a* including a passage S60 that connects the first end 157 and the second end 159 to each other.

In this embodiment, the passage 860 is configured by a groove portion formed in the outer surface 158*a* of the fitting portion 656. The passage S60 includes a plurality of first passage portions S61 and a plurality of second passage portions S62.

The plurality of first passage portions S61 are formed along an axial direction of the fitting portion 656. The plurality of second passage portions S62 are formed along a circumferential direction of the fitting portion 656 and connect the plurality of first passage portions S61 to one another. Some of the plurality of second passage portions S62 may be formed not to connect the plurality of first passage portions S61 to one another.

The passage S60 may be configured by square grooves or round grooves. The arrangement intervals of the passage S60, the passage width, and the like are not particularly limited. The passage S60 is formed having a size capable of giving a predetermined fitting feeling to the ear canal and providing a passage width with which moisture in the ear canal can be suitably received.

Also with the earpiece 650 having the above-mentioned configuration according to this embodiment, the same action and effect as those of the first embodiment can be provided.

<Seventh Embodiment>

Figure 15:
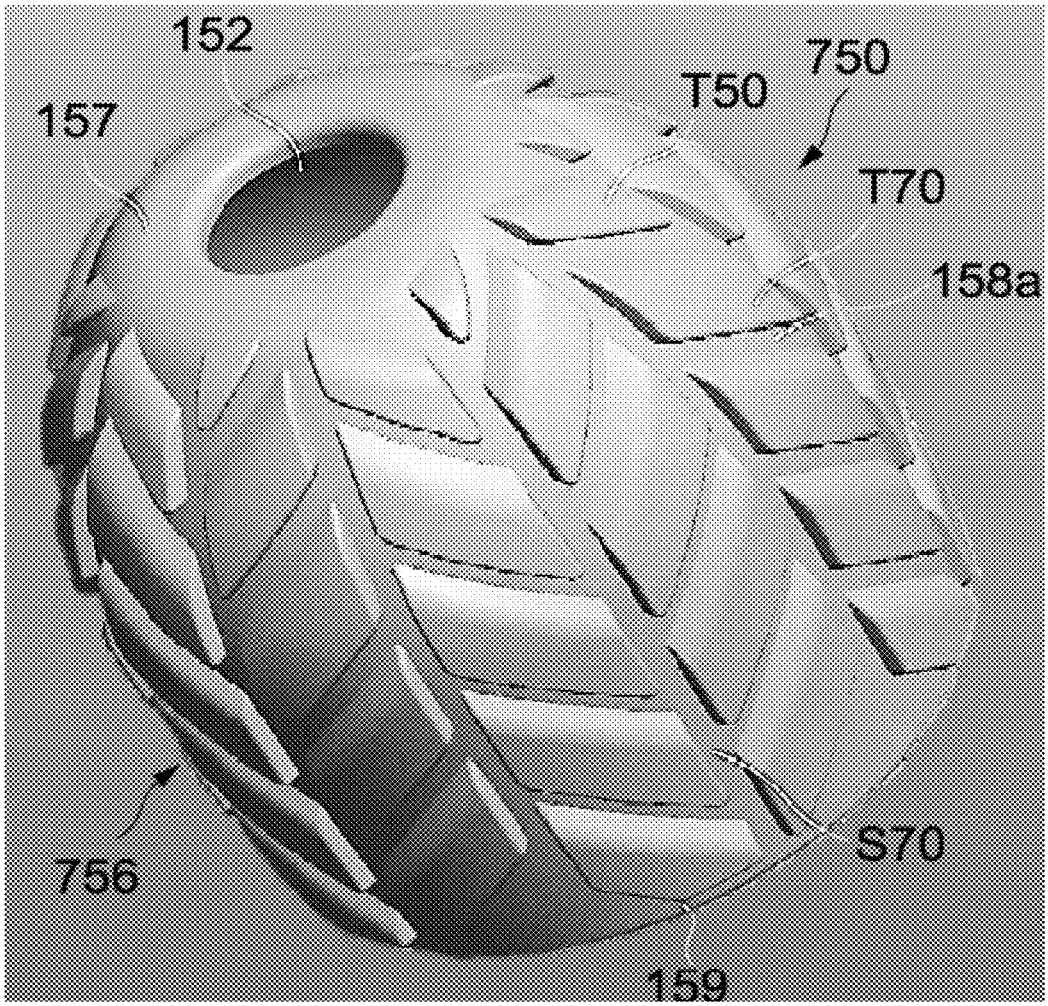
FIG. 15 is a perspective view showing an outer appearance of an earpiece according to a seventh embodiment of the present technology.

FIG. 15 is a perspective view showing an outer appearance of an earpiece according to a seventh embodiment of the present technology. Hereinafter, components different from those of the first embodiment will be mainly described, and the same components as those of the above-mentioned embodiment will be denoted by the same reference symbols and descriptions thereof will be omitted or simplified.

An earpiece 750 according to this embodiment includes a fitting portion 756 and an attachment portion 152 disposed inside the fitting portion 756. The fitting portion 756 corresponds to the fitting portion 156 described in the first embodiment and includes a first end 157, a second end 159, and an outer surface 158*a* including a passage S70 that connects the first end 157 and the second end 159 to each other.

The passage S70 is formed among a plurality of protrusions T70. As in the first embodiment, the plurality of protrusions T70 are arranged at predetermined intervals in an axial direction and a circumferential direction of the fitting portion 756. In this embodiment, the plurality of protrusions T70 have the same shape as those of the protrusions T10 described in the first embodiment. However, in comparison with the first embodiment, the plurality of protrusions T70 are arranged in the outer surface 158*a* of the fitting portion 756 with a higher density. Thus, the passage S70 in this embodiment is formed to be narrower than the passage S10 in the first embodiment.

Also with the earpiece 750 having the above-mentioned configuration according to this embodiment, the same action and effect as those of the first embodiment can be provided. Further, as in this embodiment, the width of the passage can be arbitrarily adjusted by the number of protrusions. In addition, by setting the width of the passage to be relatively narrow, it is possible to reduce individual variation in audibility of external sounds.

MODIFIED EXAMPLE

Although the embodiments of the present technology have been discussed above, the present technology is not limited only to the above embodiments and can be variously changed without departing from the gist of the present technology, of course.

For example, although, in the above embodiments, the earphones for playing music tracks are used as an example of the electro-acoustic transducer, the present technology is not limited thereto and can also be applied to a hearing aid and the like.

Further, although, in the above embodiments, the passage formed in the fitting portion surface is configured by the first and second passage portions, it is not limited thereto and the passage may be configured only by the first passage portions, for example.

In addition, the shape and arrangement of the protrusions formed in the fitting portion surface and the form of the passage formed in the fitting portion surface are not limited to the above-mentioned examples and various modifications can be made as schematically shown in FIGS. 16 to 21. Note that FIGS. 16 to 21 each show only a form of an outer appearance of a protrusion for the sake of description and an illustration of a protruding form of protrusions is omitted.

Figure 16:
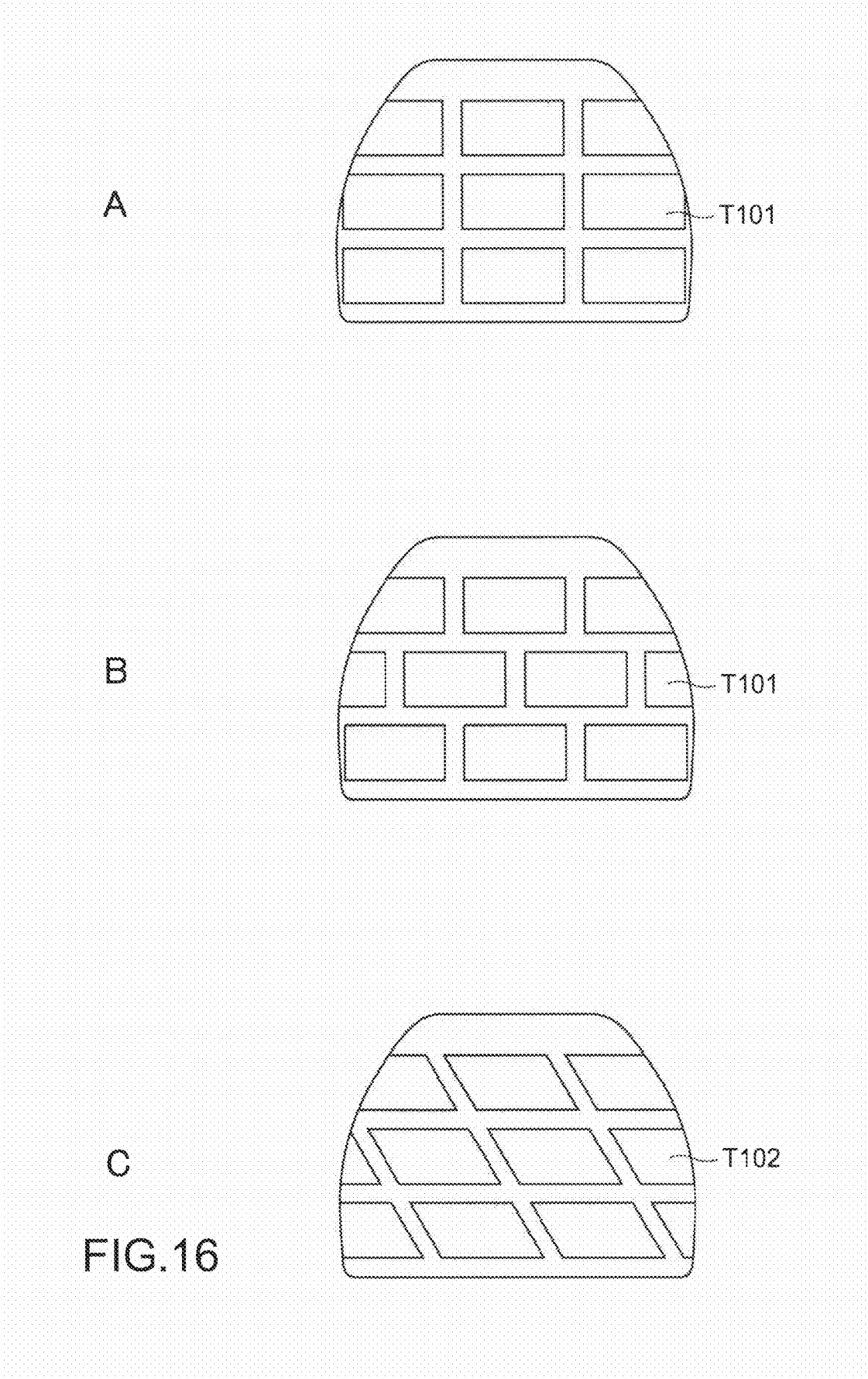
FIG. 16 is a schematic side view of earpieces according to modified examples.

As shown in Section A of FIG. 16, a plurality of rectangular protrusions T101 may be arranged in the axial direction and the circumferential direction. As shown in Section B of FIG. 16, protrusions T101 may be arranged in the axial direction, offset at predetermined pitches in the circumferential direction. As shown in Section C of FIG. 16, a plurality of parallelogram-shaped protrusions T102 such that their long sides and short sides are respectively aligned with one another.

Figure 17:
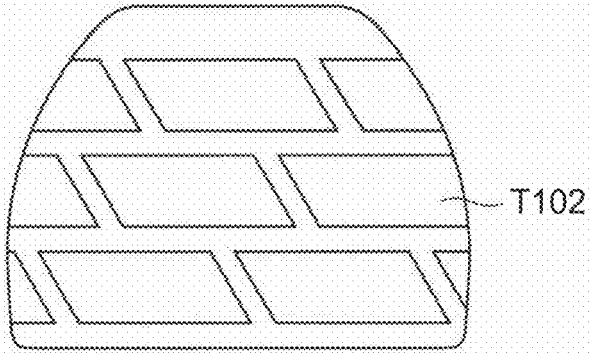
FIG. 17 is a schematic side view of earpieces according to modified examples.
Figure 17:
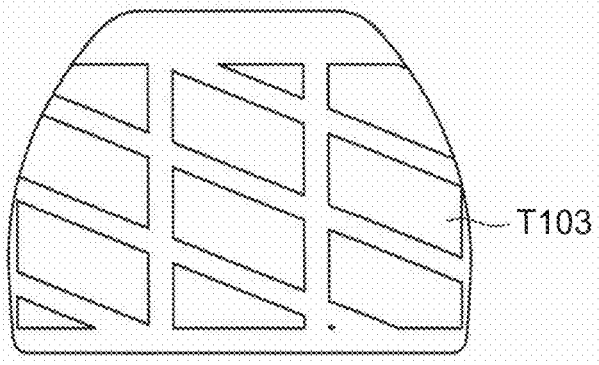
Figure 17:
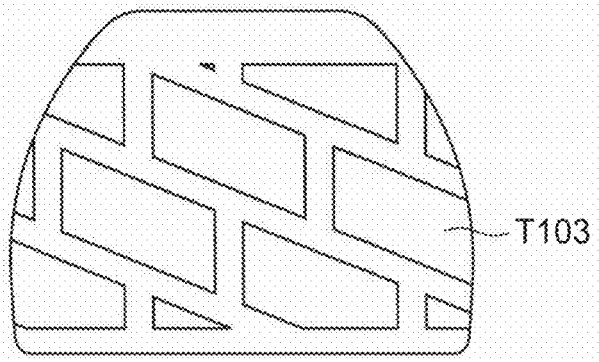
Figure 18:
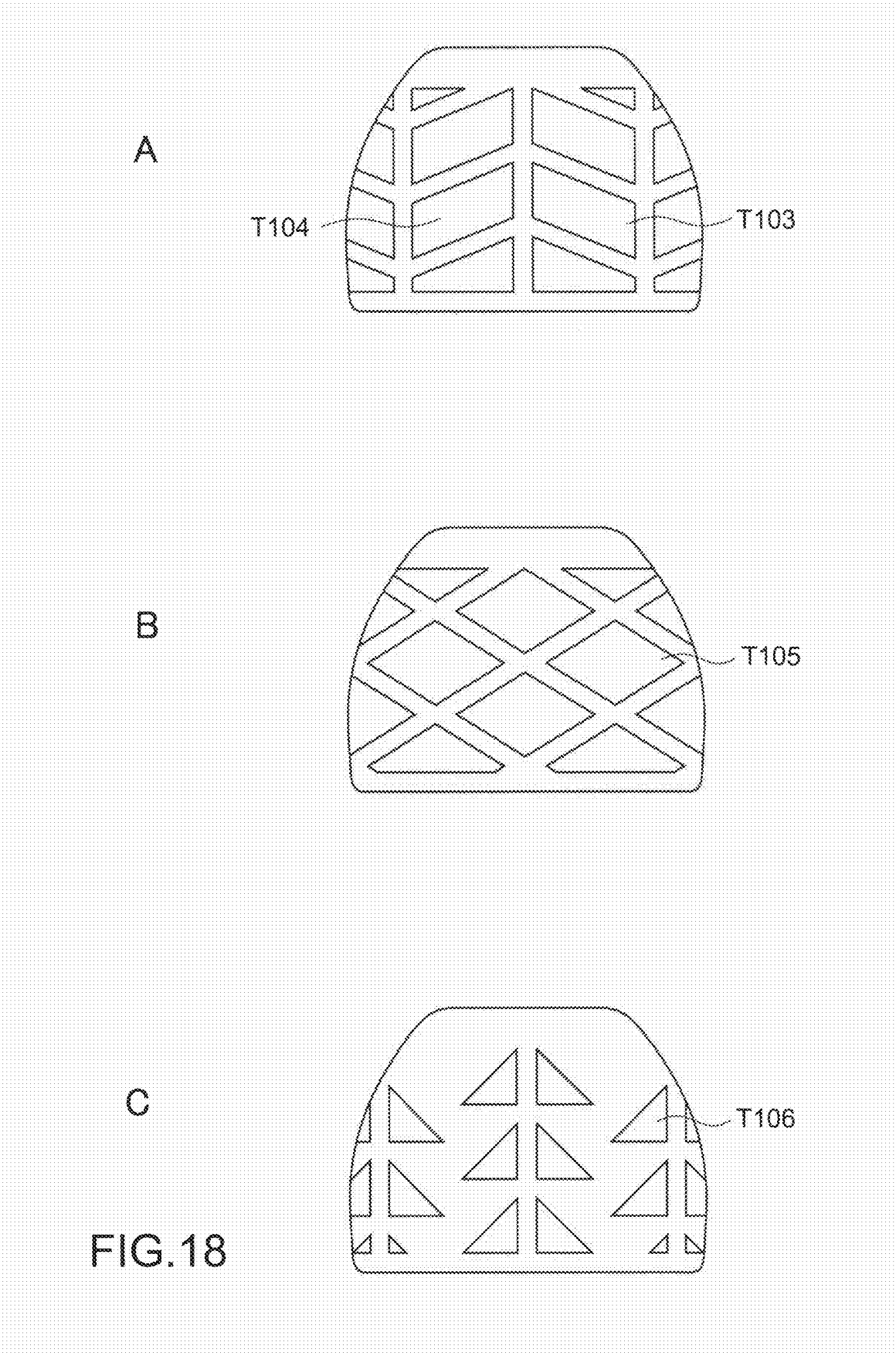
FIG. 18 is a schematic side view of earpieces according to modified examples.
Figure 19:
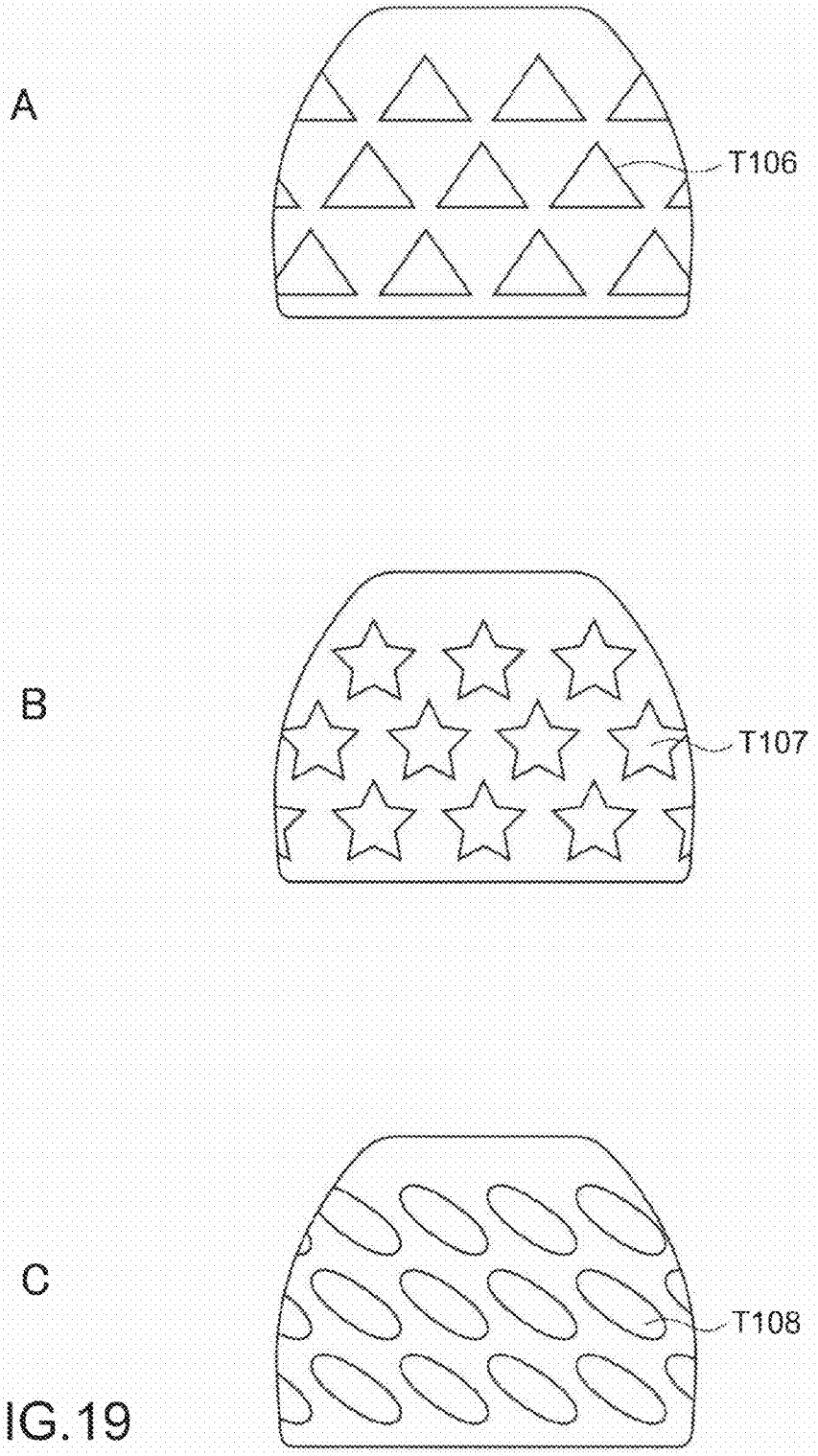
FIG. 19 is a schematic side view of earpieces according to modified examples.

Alternatively, as shown in Section A of FIG. 17, protrusions T102 may be arranged in the axial direction, offset at predetermined pitches in the circumferential direction. As shown in Section B of FIG. 17, a plurality of parallelogram-shaped protrusions T103 may be arranged in the axial direction such that edge portions on the short side are aligned with one another in the axial direction. As shown in Section C of FIG. 17, protrusions T103 may be arranged in the axial direction, offset at predetermined pitches in the circumferential direction. Alternatively, as shown in Section A of FIG. 18, protrusions T103 and protrusions T104 axially symmetrical thereto may be alternately arranged in the circumferential direction.

The shape of the protrusions is not limited to the above examples. Rhombic protrusions T105 may be used as shown in Section B of FIG. 18 or triangular protrusions 1106 may be used as shown in Section C of FIG. 18 and Section A of FIG. 19. Alternatively, the protrusions may be star-shaped protrusions T107 as shown in Section B of FIG. 19 or may be oval or elliptical protrusions T108 as shown in Section C of FIG. 19.

Figure 20:
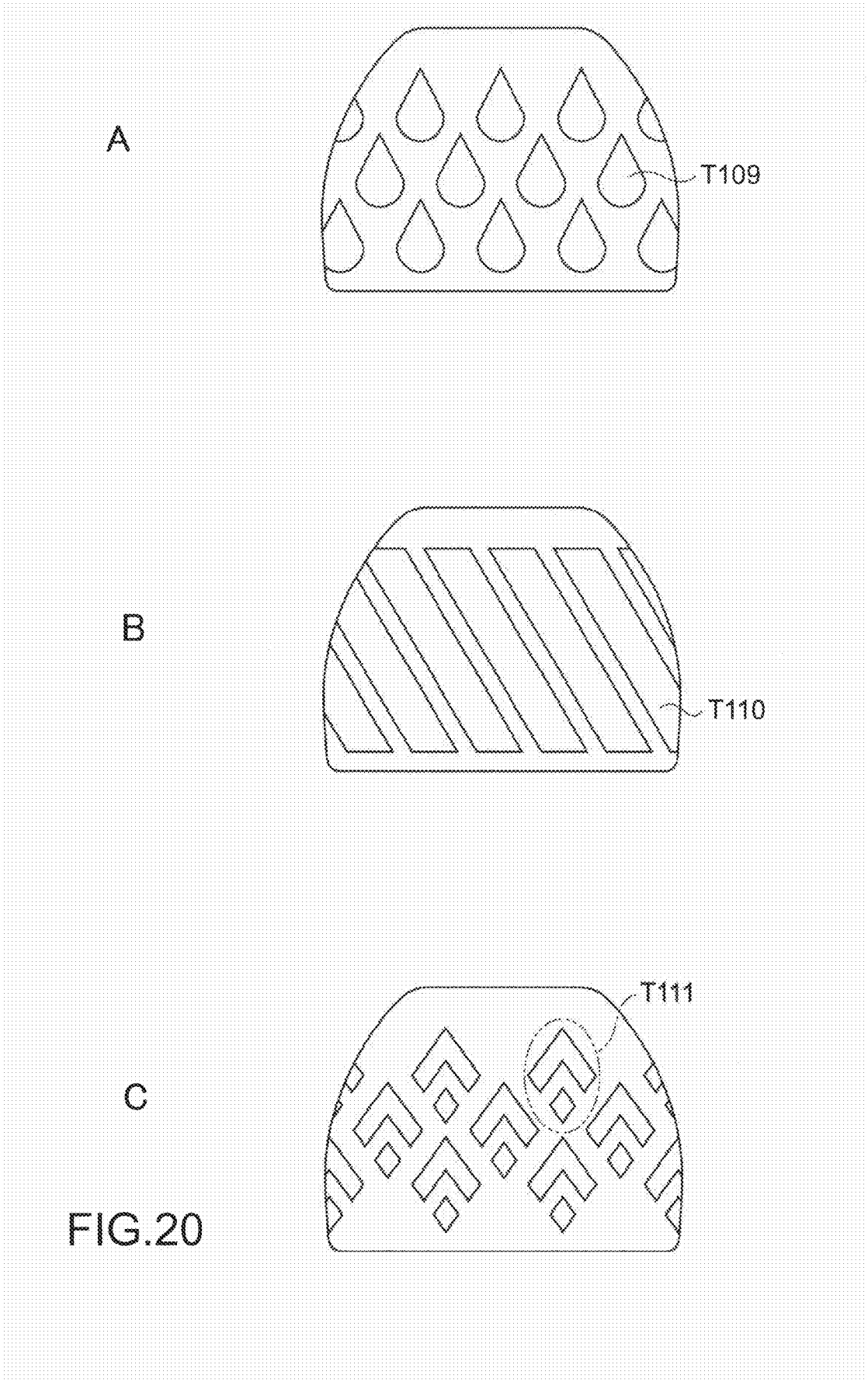
FIG. 20 is a schematic side view of earpieces according to modified examples.
Figure 21:
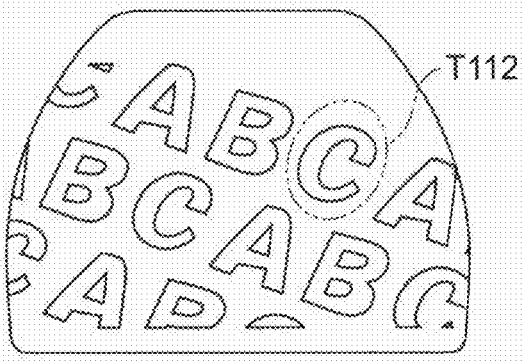
FIG. 21 is a schematic side view of earpieces according to modified examples.
Figure 21:
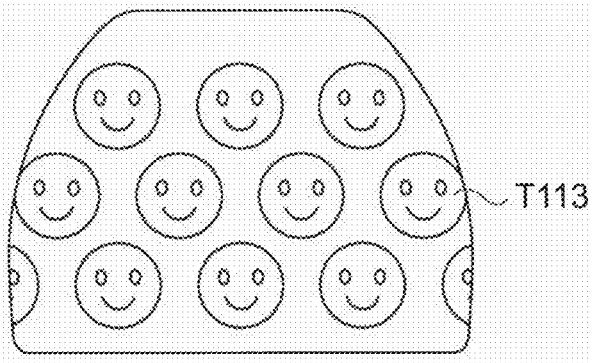

Alternatively, the protrusions may be drop-shaped protrusions T109 as shown in Section A of FIG. 20 or may be strip-shaped protrusions T110 as shown in Section B of FIG. 20. Alternatively, a plurality of protrusions T111 having different shapes may be employed as shown in Section C of FIG. 20.

The form of the protrusions is not limited to a simple geometric form. Protrusions T112 forming predetermined characters may be used as shown in Section A of FIG. 21. Alternatively, protrusions T113 decorated in a predetermined manner may be used as shown in Section B of FIG. 21.

Note that the present technology may also take the following configurations.

(1) An earpiece, including:
a fitting portion including
a first end,
a second end, and
an outer surface including a passage that connects the first end and the second end to each other; and
an attachment portion that is disposed inside the fitting portion to be engaged to a sound guide tube of an electro-acoustic transducer.

(2) The earpiece according to (1), in which
the passage is formed among a plurality of protrusions provided in the outer surface.

(3) The earpiece according to (1), in which
the passage is a groove portion formed in the outer surface.

(4) The earpiece according to any one of (1) to (3), in which
the passage includes a plurality of first passage portions formed along an axial direction of the fitting portion.

(5) The earpiece according to (4), in which
the passage further includes a plurality of second passage portions that connect the plurality of first passage portions to one other.

(6) The earpiece according to (2), in which
the plurality of protrusions each include
a first edge portion having a taper shape formed on a side of the first end, and
a second edge portion having an edge shape formed on a side of the second end.

(7) The earpiece according to (2), in which
the plurality of protrusions have a sucker shape.

(8) The earpiece according to any one of (1) to (7), in which
the fitting portion further includes a plurality of through-holes provided in the passage.

It should be understood by those skilled in the art that various modifications, combinations, sub-combinations and alterations may occur depending on design requirements and other factors insofar as they are within the scope of the appended claims or the equivalents thereof.

What is claimed is:

1. An earpiece, comprising:
a fitting portion including
a first end,
a second end, and
an outer surface formed in a dome shape having an opening corresponding to a center of the dome shape, the opening being at the first end, and including a plurality of protrusions arranged axially and transversely on the outer surface forming a passage among the plurality of protrusions, the passage extending along the outer surface from the first end to the second end; and
an attachment portion that is disposed inside the fitting portion to be engaged to a sound guide tube of an electro-acoustic transducer, wherein
each protrusion of the plurality of protrusions affixes to the outer surface at a base of the protrusion and a height of the protrusion is less than a width of the base of the protrusion, and the height of the protrusion is a distance from the base of the protrusion to a top of the protrusion.

2. The earpiece according to claim 1, wherein the passage is a groove portion.

3. The earpiece according to claim 1, wherein
the passage includes a plurality of first passage portions formed along an axial direction of the fitting portion.

4. The earpiece according to claim 3, wherein the passage further includes a plurality of second passage portions that connect the plurality of first passage portions to one other.

5. The earpiece according to claim 4, wherein the plurality of second passage portions are arranged along a transverse direction of the fitting portion, the transverse direction being orthogonal to the axial direction and a radial direction.

6. The earpiece according to claim 1, wherein each protrusion of the plurality of protrusions includes
a first edge portion having a taper shape formed on a side of the first end, and a second edge portion having a corner formed on a side of the second end.

7. The earpiece according to claim 1, wherein the plurality of protrusions have a sucker shape.

8. The earpiece according to claim 1, wherein the fitting portion further includes a plurality of through-holes provided in the passage.

9. The earpiece according to claim 1, wherein the plurality of protrusions is further configured to direct a fluid to the passage to maintain frictional contact between the protrusions and an ear canal when the earpiece is arranged in the ear canal.

10. The earpiece according to claim 1, wherein the plurality of protrusions is further configured to frictionally adhere to an ear canal when the earpiece is arranged in the ear canal.

11. The earpiece according to claim 1, wherein the passage is configured to discharge from the first end a fluid on an inner wall of an ear canal when the earpiece is arranged in the ear canal.

12. The earpiece according to claim 1, wherein a shape of the plurality of protrusions is configured to impede the earpiece from slipping from of an ear canal when the earpiece is arranged in the ear canal.

13. An earpiece, comprising:
a fitting portion including
a first end,
a second end, and
an outer surface formed in a dome shape having an opening corresponding to a center of the dome shape, the opening being at the first end, and including a plurality of protrusions arranged axially and transversely on the outer surface forming, among the plurality of protrusions, a passage configured to discharge moisture from the first end to the second end, the passage extending along the outer surface from the first end to the second end; and
an attachment portion that is disposed inside the fitting portion to be engaged to a sound guide tube of an electro-acoustic transducer, wherein
each protrusion of the plurality of protrusions affixes to the outer surface at a base of the protrusion and a height of the protrusion is less than a width of the base of the protrusion, and the height of the protrusion is a distance from the base of the protrusion to a top of the protrusion.

14. An electro-acoustic transducer, comprising:

a main body including an electro-acoustic transducer element, and a sound guide tube configured to output an acoustic wave generated by the electro-acoustic transducer element; and an earpiece including a fitting portion including a first end, a second end, and an outer surface formed in a bowl shape having an opening corresponding to a center of the bowl shape, the opening being at the first end, and including a plurality of protrusions arranged axially and transversely on the outer surface forming a passage among the plurality of protrusions, the passage extending along the outer surface from the first end to the second end, and an attachment portion that is disposed inside the fitting portion to be engaged to the sound guide tube, wherein each protrusion of the plurality of protrusions affixes to the outer surface at a base of the protrusion and a height of the protrusion is less than a width of the base of the protrusion, and the height of the protrusion is a distance from the base of the protrusion to a top of the protrusion.

* * * * *